US007351144B2

(12) United States Patent
Daly

(10) Patent No.: US 7,351,144 B2
(45) Date of Patent: Apr. 1, 2008

(54) BONUS GAME USING A SUBSET OF REELS

(75) Inventor: Terence Gerard Daly, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 130 days.

(21) Appl. No.: 10/615,888

(22) Filed: Jul. 8, 2003

(65) Prior Publication Data

US 2005/0009596 A1 Jan. 13, 2005

(51) Int. Cl.
*A63F 9/24* (2006.01)

(52) U.S. Cl. ..... 463/20; 463/16; 273/138.1

(58) Field of Classification Search ..... 463/16–20; 273/143 R, 138.1, 139
See application file for complete search history.

(56) References Cited

U.S. PATENT DOCUMENTS

| | | | | |
|---|---|---|---|---|
| 5,704,835 | A | 1/1998 | Dietz, II | |
| 5,775,692 | A | 7/1998 | Watts et al. | |
| 5,935,002 | A | 8/1999 | Falciglia | |
| 6,015,346 | A | 1/2000 | Bennett | |
| 6,062,980 | A | 5/2000 | Luciano | |
| 6,120,378 | A | 9/2000 | Moody et al. | |
| 6,126,542 | A * | 10/2000 | Fier | 463/16 |
| 6,159,095 | A | 12/2000 | Frohm et al. | |
| 6,270,412 | B1 | 8/2001 | Crawford et al. | |
| 6,375,570 | B1 * | 4/2002 | Poole | 463/31 |
| 6,379,245 | B2 | 4/2002 | De Keller | |
| 6,604,740 | B1 * | 8/2003 | Singer et al. | 273/292 |
| 2001/0046890 | A1 | 11/2001 | Ferguson | |
| 2001/0054794 | A1 | 12/2001 | Cole et al. | |
| 2002/0014740 | A1 | 2/2002 | Ainsworth | |
| 2002/0055381 | A1 | 5/2002 | Tarantino | |
| 2003/0073480 | A1 * | 4/2003 | Thomas et al. | 463/18 |
| 2004/0224745 | A1 * | 11/2004 | Bregenzer | 463/16 |
| 2004/0242313 | A1 * | 12/2004 | Munoz | 463/20 |

OTHER PUBLICATIONS

"Squeeze Play" The Price is Right. 1977 [online] , [retrieved Oct. 16, 2003]. Retrieved from the Internet: <URL:http://gscentral.net/squeeze.html>.*

"Squeeze Play" The Price Is Right, 1977 [online], [retrieved Oct. 16, 2003], Retrieved from the Internet: <URL:http://gcentral.net.squeeze.html>.

* cited by examiner

*Primary Examiner*—Robert E Pezzuto
*Assistant Examiner*—Alex F. R. P. Rada, II
(74) *Attorney, Agent, or Firm*—Brooke W. Quist; Andrew B. Chen; J. P. Cody

(57) ABSTRACT

A gaming method includes spinning the plurality of reels 20 within a display window 30 of the gaming machine 10. A subset of the spinning reels 20 is then selected for use in determining the game outcome. The non-selected reels are removed from a player's view within the display window 30. The selected reels are then appealingly repositioned into a closer grouping within the display window. The gaming machine then determines if the selected and repositioned reels produce a winning game outcome. A prize is awarded if a winning game outcome is achieved.

29 Claims, 4 Drawing Sheets

BONUS GAME USING A SUBSET OF REELS

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

This invention relates generally to a reel spinning game, and more particularly, to a reel spinning game where a subset of reels are selected by a player from a plurality of spinning reels, and this subset of selected reels is used to determine the game result.

BACKGROUND OF THE INVENTION

A standard slot machine includes between three and five rotatable reels for use in game play. On the periphery of each reel are gaming symbols, such as assorted fruit, numbers, and/or bar symbols. The reels are caused to spin until each reel reaches a resting position. The success or failure of the game is then determined by comparing the combination of reel symbols that are displayed when the reels are in their resting positions.

To add interest to the game, many different types of slot machine have developed over time. For example, in some slot machines the display windows show more than one adjacent symbol on each reel, thereby allow betting involving multiple rows. Other types of slot machines have also been developed to increase player interest that include "second chance" games. Typically, "second chance" games try to maintain player interest from a first game segment to a second game segment by providing the player with another opportunity to win.

However, there is a continuing need for additional slot machine variants that provide a player with enhanced excitement and diversity of game play, without departing so far from the original slot gaming concept that player comfort is lost. Further, there is a continuing need for a gaming machine that provides increased player excitement due to the visual entertainment that occurs specifically in response to the player's actions. Accordingly, those skilled in the art have long recognized the need for a gaming machine that addresses these issues. The present invention clearly fulfills these and other needs.

SUMMARY OF THE INVENTION

Briefly, and in general terms, the present invention resolves the above and other problems by providing a method for playing a reel selection slot machine. The gaming method includes: spinning a plurality of reels within a display window with each reel displaying one or more game symbols; selecting a subset of the plurality of reels for use in determining a game outcome; removing the non-selected reels from a player's view within the display window; consolidating the selected reels within the display window; determining if the selected reels produce a winning game outcome; and awarding a prize if a winning game outcome is achieved.

In one preferred embodiment, the consolidating of the selected reels involves moving the selected reels into a traditional slot machine reel configuration. In another preferred embodiment, the consolidating of the selected reels involves juxapositioning the selected reels to eliminate any non-contiguous positioning of the selected reels produced by the removal the non-selected reels.

In accordance with another preferred embodiment, the selection of the subset of reels for use in determining a game outcome is at least partially player controlled. However, in another preferred embodiment, the selection of the subset of reels is at least partially computer controlled.

In accordance with still another aspect of a preferred embodiment, the plurality of reels are mechanical reels. In other preferred embodiments, the plurality of reels are video representations of physical reels. Some such video embodiments further include randomly changing the position of the selected reels after the removing of the non-selected reels. In another preferred embodiment, the gaming method is used as a bonus game in conjunction with an underlying primary game. As such, a winning game outcome in the bonus game may result in awarding a bonus prize that is added to the prize won in the underlying primary game. However, in another embodiment, a winning game outcome in the bonus game may result in multiplying the prize won in the underlying primary game.

Additionally, in accordance with still another preferred aspect, a non-winning game outcome in the bonus game may reduce a prize won in the underlying primary game. Furthermore, in some embodiments a non-winning game outcome in the bonus game includes at least the possibility of losing a prize won in the underlying primary game. Finally, in yet other preferred embodiments, the gaming method is used as a primary game.

In accordance with the present invention, a preferred gaming method may also be described as including: spinning a plurality of reels; selecting a subset of the plurality of reels for use in determining a game outcome; removing the non-selected reels from a player's view; rearranging the selected reels adjacent to one another; determining if the selected reels produce a winning game outcome; and awarding a prize if a winning game outcome is achieved.

Still another preferred gaming method may only include: spinning a plurality of reels; selecting a subset of the plurality of reels for use in determining a game outcome; juxapositioning the selected reels to eliminate any non-contiguous positioning of the selected reels resulting from interstitial location of non-selected reels; determining if the selected reels produce a winning game outcome; and awarding a prize if a winning game outcome is achieved.

Other features and advantages of the present invention will become apparent from the following detailed description, taken in conjunction with the accompanying drawings, which illustrate by way of example, the features of the present invention.

DETAILED DESCRIPTION OF THE PREFERRED EMBODIMENTS

Figure 1:
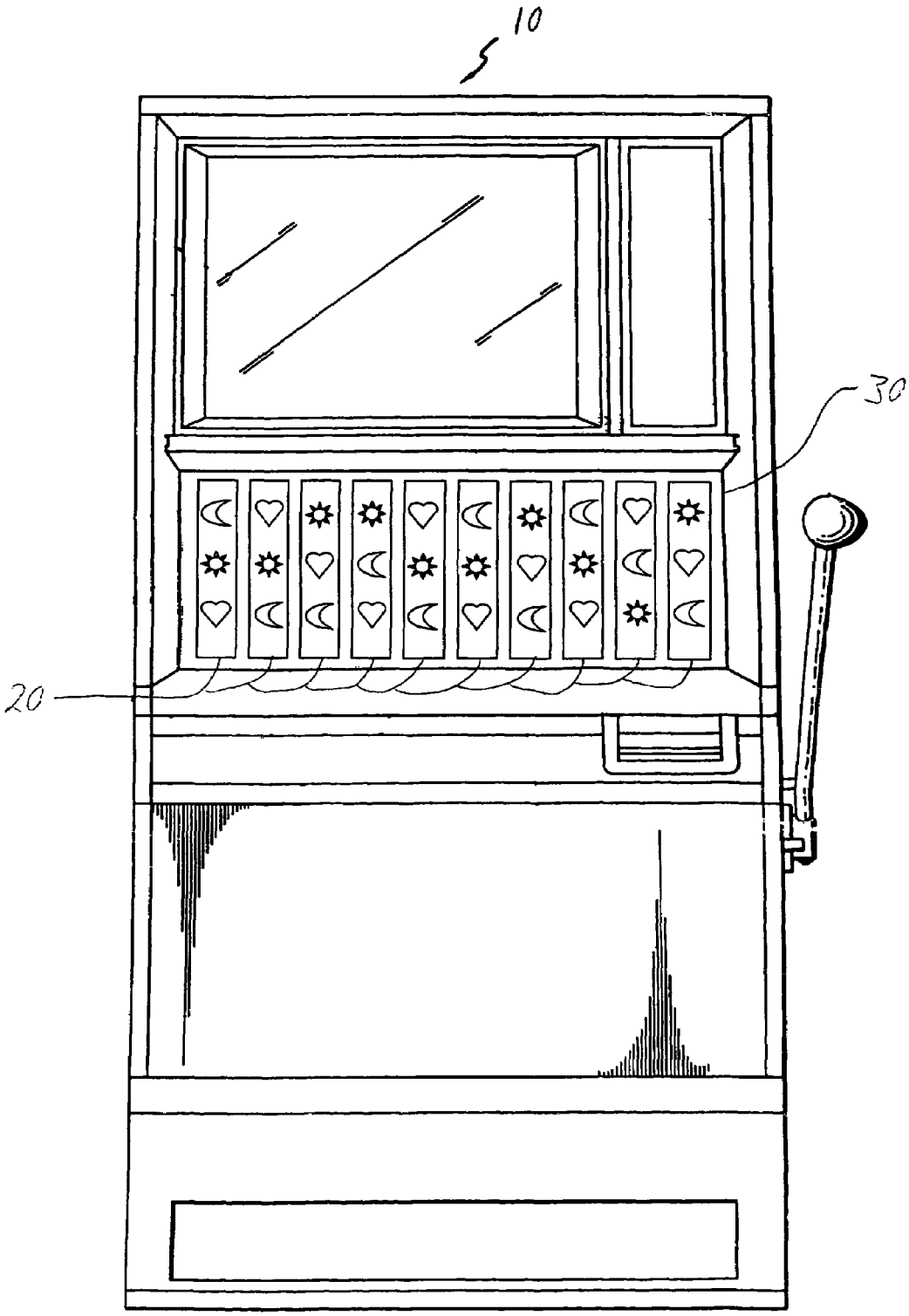
FIG. 1 illustrates a front view of a preferred embodiment, constructed in accordance with the present invention, having ten selectable reels.

A preferred embodiment gaming method, implemented in accordance with the present invention, provides a player with the opportunity to play a game of slots by selecting, from a plurality of spinning reels, the subset of the reels that will be used to determine the game outcome, after the selected reels have been consolidated into substantially adjacent positions. In this manner, player excitement is derived and heightened from the visual entertainment that occurs when the non-selected reels are removed from a player's view, and the selected reels are repositioned into a traditional slot machine reel configuration. Referring now to the drawings, wherein like reference numerals denote like or corresponding parts throughout the drawings, and more particularly to FIGS. 1-4, there is shown a preferred reel selection gaming method.

Figure 2:
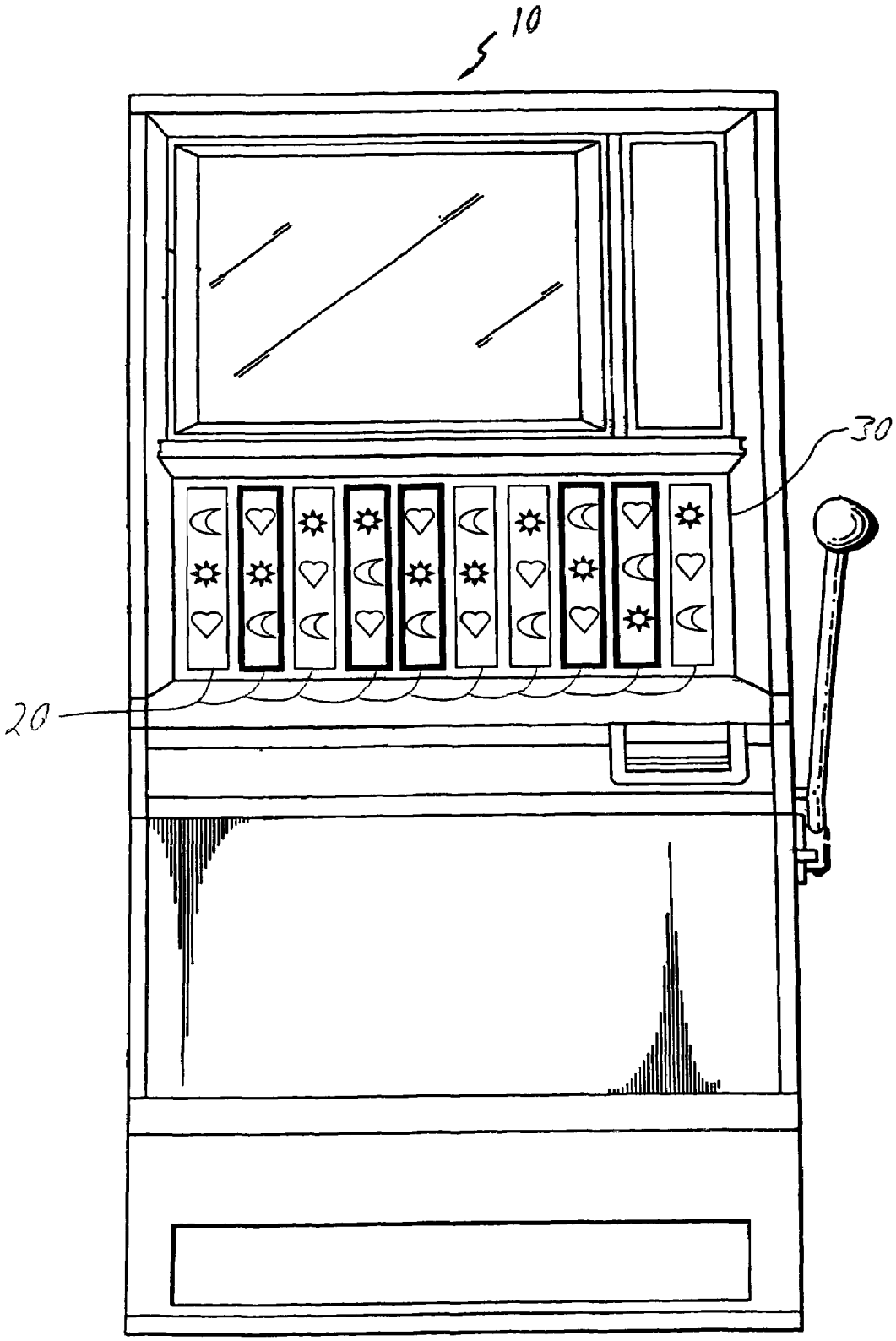
FIG. 2 illustrates a front view of the embodiment of FIG. 1, with five of the reels having been selected for use in determining a game outcome, as shown by the highlighting of the selected reels.

Briefly stated, a preferred embodiment method of the present invention includes playing a slot-style game in a gaming machine 10 by selecting, from a plurality of spinning reels 20, a subset of spinning reels that are repositioned and used as the game outcome result reels. As shown in FIG. 1, the gaming method preferably includes spinning the plurality of reels 20 within a display window 30 of the gaming machine 10. Each of the spinning reels 20 displays one or more game symbols along its periphery. Referring now to FIG. 2, the gaming method also includes selecting a subset of the spinning reels 20 to use in determining the game outcome. In FIG. 2, highlighting designates the selected reels; however, any other suitable technique may also be utilized.

Figure 3:
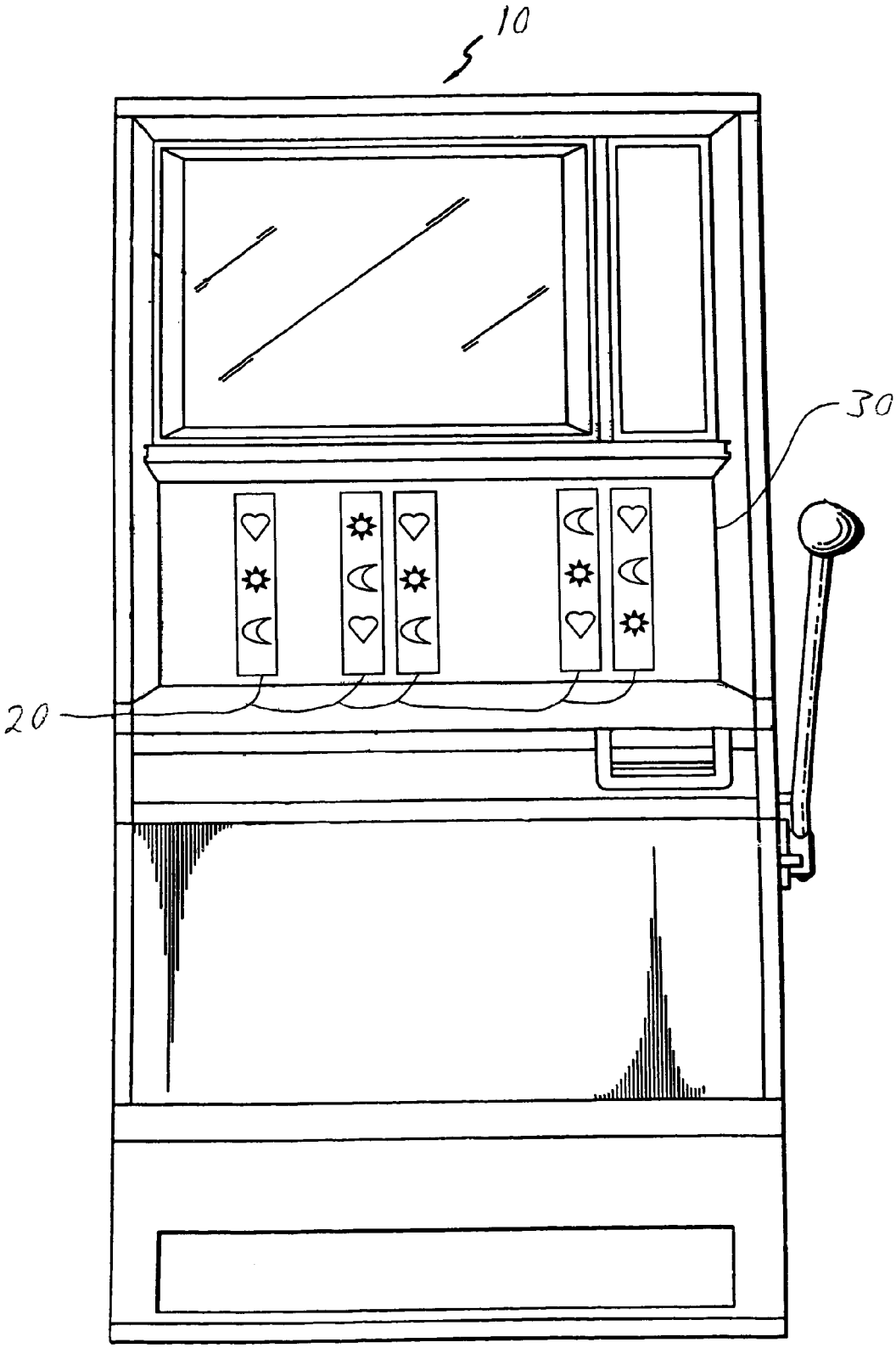
FIG. 3 illustrates a front view of the embodiment of FIG. 1, showing the five reels that were selected for use in determining a game outcome after removal of the non-selected reels.
Figure 4:
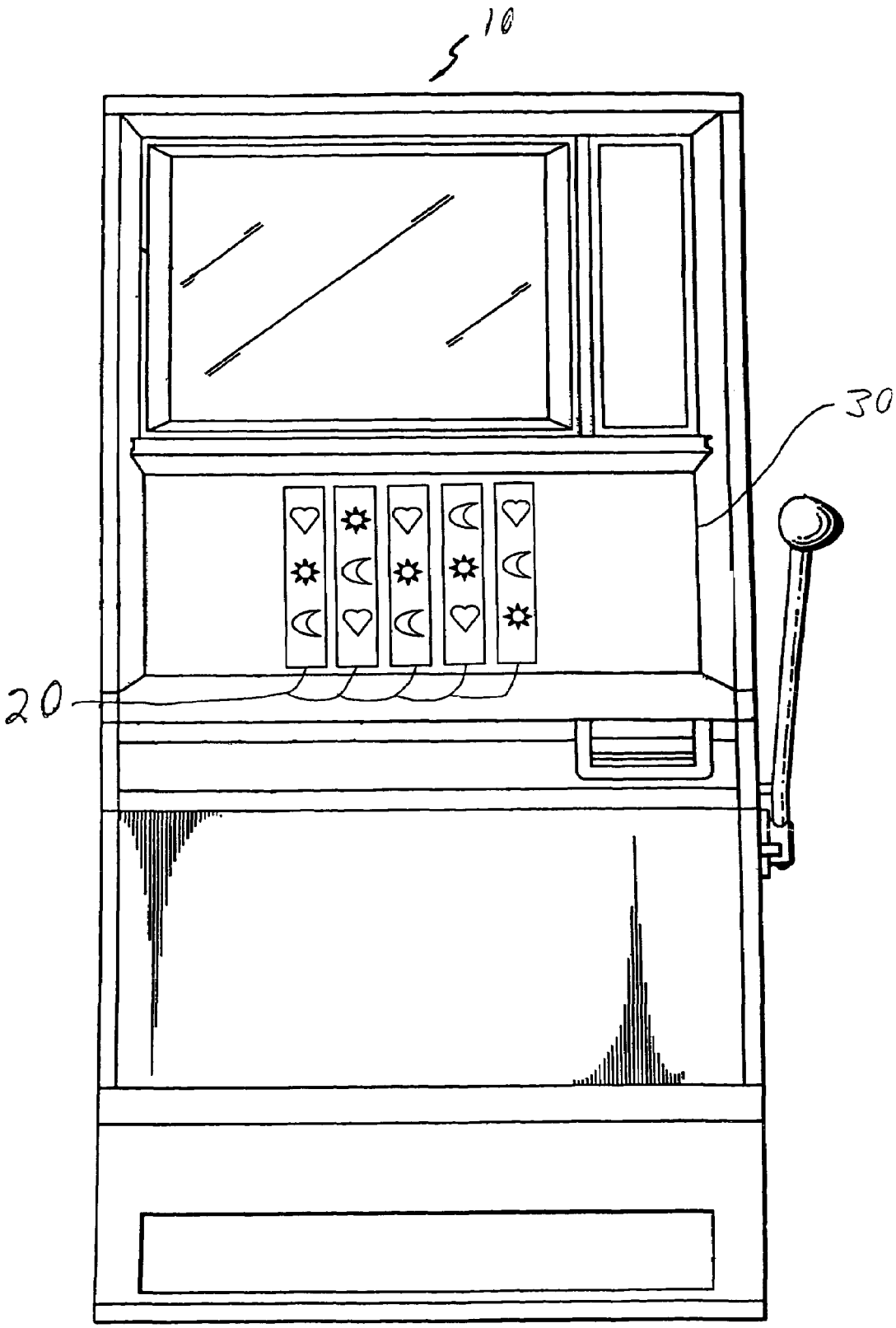
FIG. 4 illustrates a front view of the embodiment of FIG. 1, showing the five reels selected for use in determining a game outcome having been consolidated into positions adjacent one another in a traditional slot machine reel configuration.

Referring to FIG. 3, the gaming method further includes removal of the non-selected reels from a player's view within the display window 30. Additionally, as shown in FIG. 4, the gaming method includes consolidating the selected reels into a closer grouping within the display window. Further, the gaming method includes determining if the selected reels produce a winning game outcome and awarding a prize if a winning game outcome is achieved.

In one preferred method, the spinning of the selected reels is stopped after the consolidation of the selected reels within the display window. Alternatively, the spinning of the selected reels may instead be stopped before the consolidating of the selected reels. Furthermore, in other preferred embodiment methods, the spinning of selected reels is stopped before the removal of the non-selected reels from a player's view within the display window.

Referring again to FIG. 1, the gaming method preferably utilizes a gaming device 10 that has ten selectable reels 20 that are viewable within the display window 30. In other preferred embodiments, the gaming device 10 may utilize a greater or lesser number of selectable reels 20. Each of the reels 20 displays at least one game symbol on its periphery, which when stopped, can be viewed along a pay line to determine a game result. Preferably, the number of reels 20 included in the gaming device 10 is larger than that utilized for an individual game. In this regard, one preferred gaming method includes the selection of five of the ten reels 20 for use in determining a game outcome result. In other preferred embodiments, a greater or lesser number of the reels 20 may be selected for use in determining a game outcome result. Preferably, a microprocessor is used to randomly control the stopping of the spinning reels and thereby determine the game result for the gaming method of the present invention. The microprocessor also awards any prize achieved based upon that game result.

In one embodiment, the microprocessor automatically selects which of the plurality of reels 20 are used to determine the game outcome result, independent of player input. However, alternatively, the selection of the game outcome result reels may be at least partially player controlled. In this regard, some embodiments of the gaming method 10 incorporate touch screen technology (as shown in FIG. 2) that allows a player to select which of the reels 20 are to be used to determine the game result by touching a portion of the window 40 in front of the chosen reels. However, selection buttons (not shown) may also be implemented to designate which of the plurality of reels 20 are the game result reels.

Preferably, the consolidating of the selected reels involves juxapositioning the selected reels (as shown in FIG. 3) to eliminate any non-contiguous positioning of the selected reels produced by the removal the non-selected reels (as shown in FIG. 4). Additionally, it will be understood that the gaming method 10 can utilize a greater or lesser number of reels. Other preferred embodiments may also utilize multiple pay lines, and thus, have more than one symbol position of each reel visible at a time through the display window 30.

A mechanical reel system may be used instead of the video reel system described above, without departing from the scope of the present invention. In such an embodiment, each reel preferably includes a stepper motor to spin the reel. Further, in this mechanical embodiment, each reel is associated with a retractable arm that allows non-selected reels to be removed from a player's view, and the selected reels to be consolidated into position adjacent to one another. Alternatively, a hybrid slot system may be used in which some of the reels in the slot machine are mechanical while other of the reels in the slot machine are produced by a video display.

The gaming method is preferably used as a bonus game in conjunction with an underlying primary game. As such, a winning game outcome in the bonus game may result in awarding a bonus prize that is added to the prize won in the underlying primary game. Alternatively, a winning game outcome in the bonus game may result in multiplying the prize won in the underlying primary game. Additionally, in accordance with still another aspect of a preferred embodiment, a non-winning game outcome in the bonus game may reduce a prize won in the underlying primary game. Furthermore, a non-winning game outcome in the bonus game may also include at least the possibility of losing the prize won in the underlying primary game. However, it will be understood that the gaming method may also be used as a primary game, without departing from the scope of the present invention.

Furthermore, the various methodologies described above are provided by way of illustration only and should not be construed to limit the invention. Those skilled in the art will readily recognize various modifications and changes may be made to the present invention without departing from the true spirit and scope of the present invention. Accordingly, it is not intended that the invention be limited, except as by the appended claims.

What is claimed is:

1. A gaming method for playing a reel selection slot machine, the method comprising:

spinning a plurality of reels within a display window, the plurality of reels each displaying one or more game symbols;

selecting a subset of the currently spinning reels from the plurality of reels for use in determining a game outcome, wherein the selection of the reels for use in determining a game outcome is player controlled;

removing the non-selected reels from a player's view within the display window;

consolidating the selected subset of the reels within the display window, wherein consolidating the selected reels within the display window comprises juxtapositioning the selected subset of the reels to eliminate any non-contiguous positioning of the selected reels produced by the removal of the non-selected reels; and stopping the subset of the currently spinning reels and determining if the selected subset of reels produce a winning game outcome, and awarding a prize if a winning game outcome is achieved.

2. The method of claim 1, further comprising: stopping the spinning of the selected reels, before the consolidating of the selected reels within the display window.

3. The method of claim 1, further comprising: stopping the spinning of the selected reels, before the removing of the non-selected reels from a player's view within the display window.

4. The method of claim 1, wherein the plurality of reels are video representations of physical reels.

5. The method of claim 4, further comprising:

randomly changing the position of the selected reels after the removing of the non-selected reels.

6. The method of claim 1, wherein the gaming method is used as a bonus game in conjunction with an underlying primary game.

7. The method of claim 6, wherein a winning game outcome in the bonus game results in a prize that is added to a prize won in the underlying primary game.

8. The method of claim 6, wherein a winning game outcome in the bonus game results in multiplying a prize won in the underlying primary game.

9. The method of claim 6, wherein a non-winning game outcome in the bonus game reduces a prize won in the underlying primary game.

10. The method of claim 6, wherein a non-winning game outcome in the bonus game includes at least the possibility of losing a prize won in the underlying primary game.

11. The method of claim 1, wherein the gaming method is used as a primary game.

12. A gaming method for playing a reel selection slot machine that includes a plurality of reels, the method comprising:

spinning the plurality of reels;

selecting a subset of the currently spinning reels from the plurality of reels, wherein the subset of currently spinning reels is used to determine a game outcome, wherein the selection of the subset of reels for use in determining a game outcome is player controlled;

removing the non-selected reels from a player's view before determining the game outcome;

rearranging the subset of the currently spinning reels adjacent to one another before determining the game outcome;

stopping the subset of the currently spinning reels and determining if the selected reels produce a winning game outcome; and awarding a prize if a winning game outcome is achieved.

13. The method of claim 12, further comprising: stopping the spinning of the selected reels, before the rearranging of the selected reels adjacent to one another.

14. The method of claim 12, further comprising: stopping the spinning of the selected reels, before the removing of the non-selected reels from a player's view.

15. The method of claim 12, wherein rearranging the selected reels within the display window comprises juxtapositioning the selected reels to eliminate any non-contiguous positioning of the selected reels produced by the removal of the non-selected reels.

16. The method of claim 12, wherein the gaming method is used as a bonus game in conjunction with an underlying primary game.

17. The method of claim 12, wherein the gaming method is used as a primary game.

18. The method of claim 12, wherein the plurality of reels are video representations of physical reels.

19. The method of claim 18, further comprising:

randomly changing the position of the selected reels after the removing of the non-selected reels.

20. The method of claim 18, wherein a winning game outcome in the bonus game results in a prize that is added to a prize won in the underlying primary game.

21. The method of claim 18, wherein a winning game outcome in the bonus game results in multiplying a prize won in the underlying primary game.

22. The method of claim 18, wherein a non-winning game outcome in the bonus game reduces a prize won in the underlying primary game.

23. The method of claim 18, wherein a non-winning game outcome in the bonus game includes at least the possibility of losing a prize won in the underlying primary game.

24. A gaming method for playing a reel selection slot machine, the method comprising:

spinning a plurality of reels, each reel displaying game symbols thereon;

selecting a subset of the currently spinning reels from the plurality of reels, wherein the subset of reels is used to determine a game outcome;

juxtapositioning the subset of the currently spinning reels to eliminate any non-contiguous positioning of the subset of the currently spinning reels resulting from interstitial location of non-selected reels before stopping the subset of the currently spinning reels;

stopping the subset of the currently spinning reels; and determining if the selected subset of reels produce a winning game outcome, and awarding a prize if a winning game outcome is achieved.

25. A method for playing a reel selection slot machine, the method comprising:

spinning a plurality of reels, wherein the plurality of reels each displaying one or more game symbols;

selecting a subset of the currently spinning reels from the plurality of reels, wherein the subset of currently spinning reels is used to determine a game outcome;

removing the non-selected spinning reels from a player's view within the display window before determining the game outcome;

consolidating the subset of the currently spinning reels within the display window, wherein consolidating the subset of the currently spinning reels comprises juxtapositioning the subset of the currently spinning reels to eliminate any non-contiguous positioning of the subset of the currently spinning reels produced by the removal of the non-selected spinning reels;

stopping the subset of the currently spinning reels and determining if the selected subset of reels produce a winning game outcome; and awarding a prize if a winning game outcome is achieved.

26. The method of claim 25, wherein the reels are mechanical reels.

27. The method of claim 25, further comprising randomly changing the positions of the currently spinning reels after the removing of the non-selected reels.

28. A method for playing a reel selection slot machine, the method comprising:

initiating a bonus game in response to a triggering event in a primary game by spinning a plurality of reels, wherein the plurality of reels each displaying one or more game symbols;

selecting a subset of the currently spinning reels from the plurality of reels, wherein the subset of currently spinning reels is used to determine a game outcome;

removing the non-selected spinning reels from a player's view within the display window before determining the game outcome;

consolidating the subset of the currently spinning reels within the display window, wherein consolidating the subset of the currently spinning reels comprises juxtapositioning the subset of the currently spinning reels to eliminate any non-contiguous positioning of the subset of the currently spinning reels produced by the removal of the non-selected spinning reels;

stopping the subset of the currently spinning reels and determining if the selected subset of reels produce a winning game outcome; and awarding a prize if a winning game outcome is achieved.

29. The method of claim 28, further comprising decreasing a prize of the primary game in response to a non-winning game outcome of the bonus game.

* * * * *